US009521499B2

(12) United States Patent
Theuss

(10) Patent No.: US 9,521,499 B2
(45) Date of Patent: Dec. 13, 2016

(54) ELECTRONIC DEVICE WITH LARGE BACK VOLUME FOR ELECTROMECHANICAL TRANSDUCER

(71) Applicant: Infineon Technologies AG, Neubiberg (DE)

(72) Inventor: Horst Theuss, Wenzenbach (DE)

(73) Assignee: Infineon Technologies AG, Neubiberg (DE)

( * ) Notice: Subject to any disclaimer, the term of this patent is extended or adjusted under 35 U.S.C. 154(b) by 88 days.

(21) Appl. No.: 13/927,873

(22) Filed: Jun. 26, 2013

(65) Prior Publication Data

US 2015/0003659 A1 Jan. 1, 2015

(51) Int. Cl.
*H04R 31/00* (2006.01)
*H04R 19/00* (2006.01)

(52) U.S. Cl.
CPC ..... *H04R 31/006* (2013.01); *H04R 19/005* (2013.01); *H04R 2201/003* (2013.01); *H04R 2499/11* (2013.01); *Y10T 29/49005* (2015.01)

(58) Field of Classification Search
CPC ..... H04R 19/00; H04R 19/04; H04R 19/005; H04R 19/016; H04R 2201/003; H04R 1/02; H04R 1/04; H04R 2499/11; H01L 2924/3025; B81B 2201/0257; B81B 7/0064
USPC ..... 381/174–175, 189, 191, 424; 257/254, 257/416
See application file for complete search history.

(56) References Cited

U.S. PATENT DOCUMENTS

| | | | | |
|---|---|---|---|---|
| 2007/0013052 | A1* | 1/2007 | Zhe et al. | 257/704 |
| 2011/0116661 | A1* | 5/2011 | Makihata et al. | 381/174 |
| 2013/0193533 | A1* | 8/2013 | Vos | H04R 19/005 257/416 |
| 2014/0001580 | A1* | 1/2014 | Bolognia et al. | 257/416 |

* cited by examiner

*Primary Examiner* — Matthew Eason

(57) ABSTRACT

An electronic device comprising a substrate, a cover delimiting at least a part of a main surface of the substrate to thereby form a cover-substrate arrangement enclosing a hollow space and having a through hole, an electroacoustic transducer configured for converting between an electric signal and an acoustic signal and being mounted on the substrate acoustically coupled with the hollow space in such a way that the hollow space constitutes a back volume of the electroacoustic transducer, wherein the electroacoustic transducer provides an acoustical coupling between the hollow space and an exterior of the cover-substrate arrangement via the through hole, an electronic chip mounted within the cover-substrate arrangement and electrically coupled with the electroacoustic transducer for communicating electric signals between the electronic chip and the electroacoustic transducer, and at least one electronic member mounted on the substrate within the cover-substrate arrangement and configured for providing an electronic function.

17 Claims, 6 Drawing Sheets

ELECTRONIC DEVICE WITH LARGE BACK VOLUME FOR ELECTROMECHANICAL TRANSDUCER

BACKGROUND OF THE INVENTION

Field of the Invention

The present invention relates to an electronic device, to a multimedia device, and to a method of manufacturing an electronic device.

Description of the Related Art

Silicon microphones may be manufactured from a solid block of crystalline silicon material which, by applying techniques such as etching and using sacrificial layers, are processed so as to form two opposing membranes on the annular block which are connected with metallic electrodes. In the presence of acoustic waves, the membranes move, thereby changing the capacitance of the membrane-electrode arrangement which can be measured electrically via an electric signal between the electrodes. Such silicon microphones can be mounted together with a logic chip (such as an ASIC, application specific integrated circuit) in a semiconductor casing having an inlet for the acoustic waves.

The volume within the casing which opposes the acoustic wave inlet and which is partially delimited by the membranes can be denoted as back volume and significantly influences the performance of the microphone. A high back volume results in a high signal-to-noise ratio, and vice versa. The size of the back volume required for a proper performance is correlated to the size of the silicon microphone. Hence, the performance requirement directly translates into a high area consumption of the silicon microphone on a printed circuit board. At the same time, there is a continued trend towards smaller dimensions of electronic members (for instance in case of a silicon microphone, a maximum height of less than 1 mm is desired).

Thus, such height requirements contradict to the performance requirements. In other words, there is a technology-related contradiction between miniaturization and performance of silicon microphones.

SUMMARY OF THE INVENTION

There may be a need for a compact electronic device with a proper acoustic performance of an electroacoustic transducer.

According to an exemplary embodiment, an electronic device is provided which comprises a substrate, a cover (such as a lid or a casing) delimiting (for instance covering or surrounding) at least a part of a main surface of the substrate to thereby form a cover-substrate arrangement enclosing (and preferably delimiting) a hollow space and having a through hole, an electroacoustic transducer configured for converting between an electric signal and an acoustic signal and being mounted on the substrate within the hollow space in such a way that the hollow space constitutes a back volume of the electroacoustic transducer, wherein the electroacoustic transducer provides an acoustical coupling between the hollow space and an exterior of the cover-substrate arrangement via the through hole, an electronic chip mounted within the cover-substrate arrangement and electrically coupled with the electroacoustic transducer for communicating electric signals between the electronic chip and the electroacoustic transducer, and at least one electronic member mounted on the substrate within the cover-substrate arrangement and configured for providing an electronic function.

According to another exemplary embodiment, a multimedia device is provided which comprises a circuit board having an internal through hole, an exterior housing exposed to an exterior of the multimedia device, enclosing the circuit board, delimiting a hollow space together with the circuit board and having an external through hole, a pair of microphone membranes configured for converting an acoustic signal into an electric signal and being mounted on the circuit board acoustically coupled with the hollow space in such a way that the hollow space constitutes a back volume of the pair of microphone membranes, wherein the pair of microphone membranes provides an acoustical coupling between the hollow space and an exterior of the multimedia device via the internal through hole and the external through hole, and an electronic chip mounted within the exterior housing and electrically coupled with the pair of microphone membranes for processing electric signals generated by the pair of microphone membranes in response to receiving acoustic signals by the pair of microphone membranes via the external through hole.

According to yet another exemplary embodiment, a method of manufacturing an electronic device is provided, wherein the method comprises delimiting at least a part of a main surface of a substrate with a cover to thereby form a cover-substrate arrangement enclosing a hollow space and having a through hole, mounting an electroacoustic transducer configured for converting between an electric signal and an acoustic signal on the substrate acoustically coupled with the hollow space in such a way that the hollow space constitutes a back volume of the electroacoustic transducer, wherein the electroacoustic transducer provides an acoustical coupling between the hollow space and an exterior of the cover-substrate arrangement via the through hole, mounting an electronic chip within the cover-substrate arrangement and electrically coupling the electronic chip with the electroacoustic transducer for communicating electric signals between the electronic chip and the electroacoustic transducer, and mounting at least one electronic member, configured for providing an electronic function, on the substrate within the cover-substrate arrangement.

An exemplary embodiment has the advantage that a cover (such as a for instance cup-shaped lid or a surrounding casing), which needs anyway be present for covering one or more other electronic members of the electronic device, is also used for constituting, together with the mounting substrate on which the one or more other electronic members are mounted, the back volume for the electroacoustic transducer accommodated as well within the cover-substrate arrangement. By omitting a separate cover specifically covering only the electroacoustic transducer together with the electronic chip for forming the back volume, the electronic device may be rendered compact and light-weight while providing a large back volume which, in turn, results in a very good performance of the electroacoustic transducer. The synergetic use of the anyhow present cover together with the substrate for forming the back volume reduces the dimension of the electronic device, and allows for a high value of the back volume resulting in a proper signal-to-noise ratio of the electroacoustic transducer.

DESCRIPTION OF FURTHER EXEMPLARY EMBODIMENTS

In the context of the present application, the term "electronic device" may particularly denote any electronic appliance involving an electroacoustic transducer and at least one further electronic functionality. In particular, it may include any portable device having a capability of converting acoustic waves into electric signal, and/or vice versa.

The term "main surface" of a substrate may denote one of the two largest, usually opposing surfaces of a particularly plate-like substrate such as a printed circuit board. The main surfaces are usually the surfaces of the substrate which are intended to be used for mounting electronic components such as an electroacoustic transducer, an electronic chip and/or an electronic member.

The term "electroacoustic transducer" may particularly denote any electromechanical member capable of generating a secondary electric signal indicative of the content of a primary acoustic wave, such as in case of a microphone. However, the term "electroacoustic transducer" may also denote an electromechanical member generating a secondary acoustic signal indicative of a content of a primary electric signal, such as in case of a loudspeaker. The electroacoustic transducer may be particularly configured as a microelectromechanical device (MEMS), and may for instance be manufactured in semiconductor technology, particularly in silicon technology. Such an electroacoustic transducer may have two opposing and movably mounted membranes connected to electrodes so that, as a result of a change of the capacitance in response to a motion of the membranes, an electric signal between the electrodes changes characteristically, or the motion is changed characteristically upon applying an electric signal between the membranes.

The term "back volume of an electroacoustic transducer" may particularly denote a fluid-filled (for instance gas-filled, more particularly air-filled) cavity which is basically acoustically closed by one or more membranes of the electroacoustic transducer together with parts of substrate and cover. Upon moving or oscillating, the membrane(s) of the electroacoustic transducer may displace gas within the back volume, wherein it is presently believed that the acoustic performance is the better, the smaller the resistance of this gas displacement is. Thus, a high back volume results in a proper performance of the electroacoustic transducer, and vice versa. The back volume shall be substantially closed with respect to an environment by portions of substrate, cover and membrane(s) of the electroacoustic transducer. However, the skilled person is aware of the fact that one or more extremely small air channels in the membrane(s) of the electroacoustic transducers are possible or even desired in order to allow for a technically desirable small passage of air between back volume and surrounding atmosphere. However, such small air channels are usually extremely small as compared to other dimensions of the electroacoustic transducer.

The term "acoustic coupling" between the hollow space and an exterior of the cover-substrate arrangement may particularly denote a certain acoustic impedance constituted for instance by membrane(s) of the electroacoustic transducer which allows for a motion of the membrane(s) between the hollow space and the exterior, thereby providing sort of acoustic coupling between hollow space and exterior. Also the above-mentioned optional small holes in the membranes have, to a certain degree, an influence on the degree of the acoustic coupling between hollow space and exterior.

The term "electronic chip" may particularly denote a semiconductor chip having one or more integrated circuit elements therein. Such an electronic chip, which may be configured as an application specific integrated circuit (ASIC) may be provided for processing electric signals generated by the electroacoustic transducer in response to a present acoustic signal. However, in another embodiment, the electronic chip may also be configured for generating an electric primary signal having a content which is translated into an acoustic signal by applying the electric signal from the electronic chip to the electroacoustic transducer in terms of a loudspeaker.

The term "at least one electronic member" may particularly denote any kind of electronic component which is provided in addition to the electronic chip cooperating with the electroacoustic transducer. The electronic member provides an additional function over the arrangement of electroacoustic transducer and cooperating electronic chip. For instance, the at least one additional electronic member may be another semiconductor chip providing an additional function such as a GPS (Global Positioning System) module for providing a GPS function of a portable appliance as electronic device. A GPS module may, in turn, comprise a filter, an amplifier, passive members such as capacitances, etc. Other functions of the at least one electronic member is the function of a memory chip, the function of a microcontroller, the function of a sensor, or any microelectromechanical system (MEMS). A further example for the electronic members are filters (such as surface acoustic wave filters, SAW, bulk acoustic wave filters, BAW, or Thin Film Bulk Acoustic Wave Resonators, FBAR). The electronic members may further comprise a base band chip, etc.

The term "substrate" may particularly denote a physical structure which is configured for mounting electroacoustic transducer, electronic chip and/or electronic member(s). The substrate may be one single physical structure (such as a single printed circuit board) or a plurality of physical structures (such as a first printed circuit board as main board and a second printed circuit board as additional structure to be mounted on or to be provided in addition to the main board). The term "a substrate" covers a single substrate or multiple substrates or substrate portions, which substrates or substrate portions may be connected to one another.

The term "multimedia device" may particularly denote any desired electronic appliance which can be used by a user in terms of the provision of any acoustic function or service, in addition to a further function or service such as an image related function. Hence, the acoustic function or service may also be combined with an optical function or service, as provided for instance by a display such as a liquid crystal display (LCD). Therefore, the multimedia device may allow a user to manage audio content, video content, image content, alphanumeric content, etc. An example for a multimedia device is a smart phone.

The term "cover" may particularly denote any physical structure covering or surrounding at least a part of the substrate and connected to the substrate for enclosing the hollow space within the formed cover-substrate arrangement. One example of such a cover is a cup-shaped lid member connected on top of a main surface of the substrate to thereby enclose the hollow space. Another example of such a cover is a hollow casing (or a part thereof) fully surrounding the substrate and being connected thereto for instance at a lateral rim and/or on a main surface thereof to thereby also delimit a hollow space within the formed cover-substrate arrangement. The term "a cover" covers a single lid or multiple lids or lid portions, but also covers a single casing (for instance formed by two cooperating members such as two half-shells), multiple casings or lid-casing combinations.

A gist according to one exemplary embodiment (see for instance FIG. 1 to FIG. 4) is that, for instance on a main board of a user appliance with an electromechanical transducer, there are usually further sub-modules or electronic members which may require an electrical shielding in form of a for instance electrically conductive lid. Particularly in mobile communications applications, in which a specific frequency band of mobile communication or navigation is used, such electromagnetic shielding becomes more and more important to protect the electronic members from undesired electromagnetic radiation. An exemplary embodiment integrates the electroacoustic transducer (such as a MEMS chip) together with its electronic logic chip (such as an ASIC) within such a common shielding substrate-lid arrangement covering also the electronic members, wherein the lid may be mounted acoustically sealed, for example by a circumferential annular solder or adhesion connection. A separate cover lid for the electroacoustic transducer having a very limited back volume may therefore be dispensable, and a single larger lid providing a larger back volume for the electroacoustic transducer may be dual-used also for shielding the electronic members as well as the electroacoustic transducer and its electronic logic chip.

A gist according to another exemplary embodiment (see for instance FIG. 5 to FIG. 7) is that the external housing or casing—constituting another embodiment of the cover—of such an appliance (for instance the housing of a smart phone) is used partially or entirely for delimiting at least a part of the back volume. In such an embodiment, it can also be advantageous to provide for an acoustic sealing and, if necessary or desired, an electromagnetic shielding of the casing (for instance by a metallic coating of the casing, for instance to provide an electric ground or mass contact). The application housing can hence be at least partially used for forming the back volume.

The exemplary embodiments have the advantage that the back volume can be rendered large, thereby guaranteeing a high electroacoustic performance, while at the same time keeping the dimension and the weight of the electronic device small. Hence, the full benefit of the miniaturization potential of the electroacoustic transducer (for instance a silicon microphone) can be enjoyed, since the electroacoustic transducer does not necessarily have to use its own back volume. This renders possible to implement highly miniaturized wafer level based silicon microphone solutions which are rendered capable of being operable with a high performance although their dimension is very small. A further advantage of exemplary embodiments is a simplification of the assembly of the electronic device, since separate parts become dispensable (one cover and one substrate may be sufficient). A high back volume can therefore be combined with small dimensioned electroacoustic transducers by using an already existent cover covering sub-modules of an appliance. Exemplary embodiments therefore overcome the technology-related contradiction between miniaturization and performance of MEMS microphones.

In the following, further exemplary embodiments of the electronic device, the multimedia device and the method will be explained.

In an embodiment, the substrate is a printed circuit board (PCB). A printed circuit board is a proper mounting base for mounting electroacoustic transducers, electronic chips and electronic members. It is possible that a single printed circuit board is used, or a plurality of separate or interconnected printed circuit boards, for instance a main board and an additional board. However, alternatives for the substrate are possible such as a flex board, a ceramic substrate, or any other suitable electronic mounting base.

In an embodiment, the printed circuit board is a main board of the device. The main board (for instance a motherboard) of the device may be the main mounting base for the majority of electronic components of the device. Particularly, a main processor or device controller may be mounted on such a main board. A portion of the exterior casing of the device connected to the main board can be used as well as the cover for at least partially delimiting the back volume of the electroacoustic transducer.

In an embodiment, the device comprises a casing enclosing the cover (which may here be configured as a lid) and the substrate and having a further through hole so that the electroacoustic transducer provides an acoustical coupling between the hollow space and an exterior of the device via both through holes (see for instance FIG. 1). In such an embodiment, the cover is an interior lid within the exterior casing of the electronic device. In such a scenario, a sound access hole or interior through hole in the cover or the substrate and an additional exterior through hole in the exterior casing can be used for defining an acoustic path transmissive for acoustic waves from outside of the electronic device to the electroacoustic transducer. When providing the exterior casing and the cover separately, the cover can be specifically configured to the requirements of the electronic chip, the electroacoustic transducer and optionally also of the electronic members. For instance, such a cover can be made of a metal or can be provided with a metallic coating so as to function as a shielding to prevent electromagnetic radiation from the environment to act on components within the cover-substrate arrangement, thereby further improving the performance of the electronic device.

In an embodiment, the device comprises an acoustic sealing arranged for preventing leakage of acoustic waves into an intermediate space between the casing and the cover (see for instance FIG. 1). Additionally or alternatively, leakage of acoustic waves into an intermediate space between the casing and the substrate may be suppressed by such an acoustic sealing. Such an acoustic sealing (which may be made of one or more separate acoustic sealing elements) may be advantageous to limit and define the acoustic propagation path to a desired trajectory. Therefore, transmission of the acoustic waves into undesired sections of the electronic device may be prevented and the propagation of the acoustic waves towards a desired location may be promoted. Such an acoustic sealing may be formed by an annular ring of solder or adhesive material, or by a rubber ring or the like. Particularly, an acoustic sealing with regard to the exterior casing is advantageous.

In an embodiment, the casing itself is configured for electromagnetically shielding at least a part of the electronic chip and the electronic member with regard to an environment. For instance, the exterior casing may be made at least partially of an electrically conductive material. By providing the exterior casing from a metallic material or by coating a for instance plastic casing with a metallization layer, propagation of undesired electromagnetic radiation from an exterior of the device into the interior components can be suppressed, thereby further increasing the signal-to-noise ratio of the electroacoustic transducer-electronic chip arrangement as well as the performance of the other electronic members which may be sensitive to such electromagnetic radiation as well.

In an embodiment, the electroacoustic transducer is configured as a microphone for converting an acoustic signal into an electric signal. The implementation of the electroacoustic transducer as a microphone is particularly advantageous, since many electronic appliances require one or more of such electroacoustic transducers of a microphone type. For instance, a smart phone may have a first microphone for detecting speech, a second microphone for detecting surrounding acoustic waves for instance in terms of capturing videos with audio content, and a third microphone for detecting noise (for instance for noise suppression or cancellation purposes or the like). In an alternative embodiment, the electroacoustic transducer is configured as a loudspeaker for converting an electric signal into an acoustic signal. Such embodiments may additionally or alternatively comprise one or more loudspeakers with the configuration as described above.

In an embodiment, the electroacoustic transducer is a microelectromechanical system (MEMS). In such an embodiment, it is for instance possible that a support structure (particularly shaped as a hollow tube or annulus) for polysilicon membranes is formed by crystalline silicon. Metallic electrodes may be connected to the membranes so that mutual motion of the membranes in response to sound to be detected causes a change of the capacitance of the described structure which is electrically detectable via the electrodes. However, other constitutions of the electroacoustic transducer can be implemented according to other exemplary embodiments as well, for instance using a piezoelectric microphone. The thickness of the membranes may be less than 1 μm, for instance may be 300 nm or 800 nm. The electrodes may be manufactured from gold. A height of the electroacoustic transducer may be less than 1 mm, for instance not more than 800 μm. Air channels in the membranes may provide for a certain pressure equilibration between the spaces on both opposing sides of the membranes. Providing air channels in the membranes protects the membranes against damage in the presence of pressure changes, for instance changes of the external atmospheric pressure. Furthermore, an adhesive which may be used for connecting the electroacoustic transducer to the substrate may generate gases which may be removed out of the back volume via the air channels.

In an embodiment, the electronic chip (which may more generally be denoted as a logic chip) is an application specific integrated circuit (ASIC). Such an ASIC may comprise a logic circuitry which may fulfil tasks of processing the signal received from the electroacoustic transducer, such as signal amplification, signal filtering (for instance frequency filtering) and/or conversion of an analog signal into a digital signal (therefore for instance also providing an analog-to-digital conversion functionality). Hence, any desired way of signal processing may be performed by the ASIC. In case of the configuration of the electroacoustic transducer as a loudspeaker, the ASIC may provide functions such as digital-to-analog conversion or other preprocessing tasks rendering the emission of acoustic waves by the electroacoustic transducer efficient and precise.

In an embodiment, the at least one electronic member is electrically coupled to the electronic chip. In such an embodiment, the electronic member and the electronic chip may provide for a cooperating function. For instance, the acoustic signal detected by the electroacoustic transducer and pre-processed by the electronic chip may be supplied to the electronic member for further use or further processing. For instance, in the context of a voice recognition system, the further electronic member may use the content of the detected acoustic signal to execute a certain user command. More generally, electronic chip and electronic member may therefore provide a cooperating function.

In an embodiment, the cover is configured for electromagnetically shielding at least a part of the electronic chip and the electronic member with regard to an environment (see for instance FIG. 1). For example, the cover may be made at least partially of an electrically conductive material. Thus, the cover may not only be used for delimiting the sufficiently large back volume, but also for shielding electromagnetic stray radiation from an environment which may negatively influence the function of the electronic chip and/or the electronic member or members.

In an embodiment, the through hole is formed in the cover (see for instance FIG. 7) and/or in the substrate (see for instance FIG. 1). It may be desired or required that an access of the external acoustic signal to the electroacoustic transducer is performed via a through hole. In one embodiment, the through hole may be formed in the substrate. In another embodiment, it may be formed in the cover. In still a further embodiment, more than one through hole can be formed, at least one in the cover and at least one in the substrate. Acoustic waves propagating through the through hole may directly impinge on the membranes of the electroacoustic transducer which may therefore be in direct acoustic coupling with the through hole. For instance, a tubular support structure of the electroacoustic transducer may be assembled on the through hole, so that the acoustic waves may propagate through the through hole, through a through hole in the support structure and from therefore to an underside of the membrane configuration of the electroacoustic transducer.

In an embodiment, the device comprises a further cover (such as a further lid) covering at least a part of the at least one further electronic member, but not the electroacoustic transducer and not the electronic chip (see for instance FIG. 6). Thus, for instance for performing specific electromagnetic radiation shielding tasks, the further cover may only cover a part or all of the electronic members, but not the electroacoustic transducer and connected electronic chip. In such an embodiment, an external cover (or casing) may further cover electroacoustic transducer, electronic chip, and—indirectly via the additional cover—the electronic members, thereby ensuring at the same time a high back volume.

In an embodiment, an outer surface of the cover (which may here be configured as a casing) at least partially forms an outer (or exterior) surface of the device (see for instance FIG. 5). In other words, the cover may partially or entirely form the outermost casing of the electronic device. This renders the back volume extremely high and the additional effort for delimiting the back volume extremely low.

In an embodiment, the electronic chip is mounted on the substrate (see for instance FIG. 1). For example, the electronic chip may be mounted next to the electroacoustic transducer on a substrate such as a circuit board. In an alternative embodiment, the electronic chip is mounted elsewhere within the cover-substrate arrangement or juxtaposed to the one or more through holes.

In an embodiment, the electroacoustic transducer comprises two membranes having two interior surfaces facing one another and having two exterior surfaces each opposing its respectively assigned interior surface. A first exterior surface of this pair of membranes of the electroacoustic transducer faces the through hole and an opposing second exterior surface of the pair of membranes opposes the through hole and is directly acoustically coupled to an inner surface of the cover delimiting the back volume and at least partially surrounding, together with the substrate, the electronic chip and the at least one electronic member. In such an embodiment, the acoustic waves propagate towards the first exterior surface of a first of the membranes and cause the membranes to move. An opposing surface of the other membrane, oriented towards the back volume, then moves inside the back volume where, in view of the large dimension of the back volume, displacement of the gas inside there is an easy task for the membranes which can be performed with a low acoustic impedance. This motion will cause a change of a capacitance value of the membrane structure which can be detected electrically by two electrodes connected laterally to the membranes.

In an embodiment, the electroacoustic transducers operate with acoustic waves at membrane oscillation frequencies which are significantly lower than the resonant frequency of the membranes. This prevents too strong elongations of the membrane which could deteriorate or even damage the membrane.

In an embodiment, the device is configured as one of the group consisting of a portable device, a handheld device, a user equipment, a multimedia device, a mobile phone, a smart phone, a tablet computer, a laptop, a digicam, and a personal digital assistant. Exemplary embodiments may be implemented particularly with any kind of handheld devices, but can be also applied to other electronic devices such as monitors or TV sets.

Another exemplary embodiment provides an electronic device comprising:

a substrate;

a cover arranged on the substrate and forming together with the substrate a hollow space with a through hole;

an electroacoustic transducer arranged on the substrate in the hollow space in such a way that the hollow space constitutes a back volume of the electroacoustic transducer and that a front volume of the electroacoustic transducer is acoustically coupled to an exterior of the hollow space via the through hole;

an electronic chip mounted in the hollow space and electrically coupled with the electroacoustic transducer; and at least one further electronic member mounted in the hollow space and configured for providing an electronic function.

The above and other objects, features and advantages of the present invention will become apparent from the following description and the appended claims, taken in conjunction with the accompanying drawings, in which like parts or elements are denoted by like reference numbers.

BRIEF DESCRIPTION OF THE DRAWINGS

The accompanying drawings, which are included to provide a further understanding of exemplary embodiments of the invention and constitute a part of the specification, illustrate exemplary embodiments of the invention.

In the drawings.

DETAILED DESCRIPTION OF EXEMPLARY EMBODIMENTS

Figure 1:
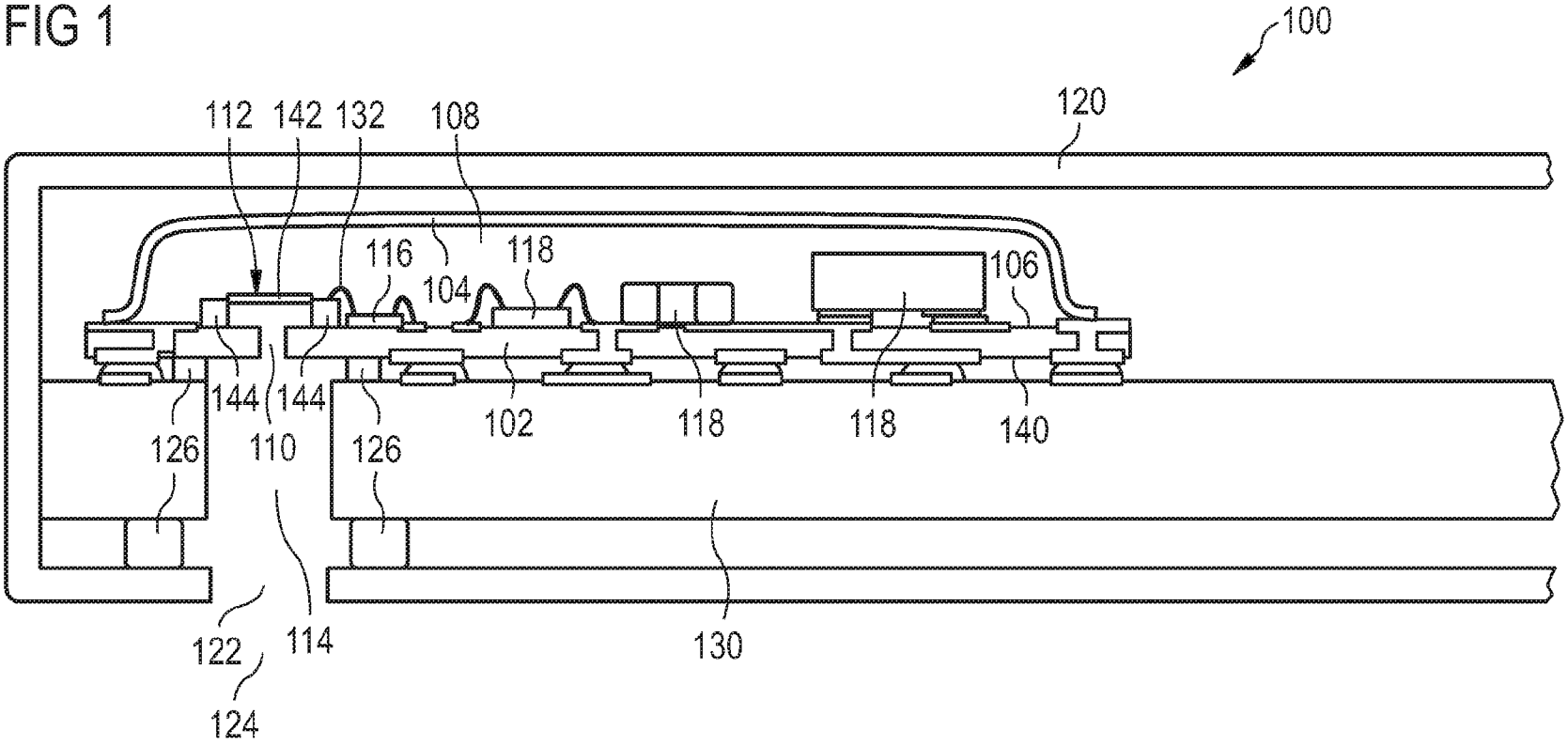
FIG. 1 illustrates a cross-section of an electronic device according to an exemplary embodiment in which a cup-shaped lid within an exterior housing forms, together with a printed circuit board on which an electroacoustic transducer and further electronic members are mounted, a back volume for the electroacoustic transducer.

The illustration in the drawing is schematically and not to scale.

In the following, referring to FIG. 1, an electronic device 100, which may be a multimedia device such as a smart phone, according to an exemplary embodiment will be explained.

The electronic device 100 comprises a first substrate 102 embodied as a printed circuit board (PCB) on which various of the electronic components of the electronic device 100 are mounted. The first substrate 102 is, in turn, mounted on a second substrate 130 which is, in the present embodiment, also embodied as a printed circuit board and forms a main board of the electronic device 100.

A lid 104, as an example for a cover contributing to the delimiting of a back volume for a microphone (see description below), made of a metallic material is circumferentially attached on and connected to the first substrate 102 and therefore covers a part of the first substrate 102 on one of its main surfaces 106. An opposing other main surface of the first substrate 102 is denoted with reference numeral 140 and is electrically and mechanically connected to the second substrate 130. Therefore, a lid-substrate arrangement is formed by the lid 104 and by a part of the first substrate 100, which lid-substrate arrangement encloses a hollow space 108. The lid-substrate arrangement comprises a through hole 110 formed in the first substrate 102.

The electronic device 100 furthermore comprises an electroacoustic transducer 112 embodied as a silicon MEMS microphone. The electroacoustic transducer 112 has two membranes 142 (details not shown) movably mounted on a tubular support body 144 and is configured for receiving acoustic waves propagating from an environment through an external through hole 122 formed in an external casing 120, through a main board through hole 114 formed in the second substrate 130 and through the through hole 110 in the first substrate 102 towards the pair of membranes of the electroacoustic transducer 112. Between two electrodes (not shown) connected to the membranes, an electric signal can be detected which is indicative of the content of the sound waves to be captured. This electric signal can be detected as a result of a capacitance change between the two electrodes connected at lateral portions of the membranes of the electroacoustic transducer 112 and can be supplied, via a cable connection 132, to an electronic chip 116. The electronic chip 116 is embodied as an ASIC and serves as a logic chip for amplifying, filtering and digitizing the electric signal, i.e. for further processing the electric signal. Thus, the electric signal processed by the electronic chip 116, embodied as a semiconductor chip with integrated circuit components therein, is an electronic fingerprint of the acoustic signal detected by the electroacoustic transducer 112.

As can be taken from FIG. 1, the electroacoustic transducer 112 is mounted on the first substrate 102 within the hollow space 108 in such a way, that the hollow space 108 forms the back volume of the electroacoustic transducer 112. This is achieved by arranging the membranes of the electroacoustic transducer 112 with one exterior surface facing the through holes 110, 114, 122 and the other external surface being oriented towards the arrangement of the lid 104 and the first substrate 100. The two internal surfaces of the membranes are arranged next to one another. Since the membranes of the electroacoustic transducer 112 may move (for instance oscillate) between the air volume related to the through holes 110, 114, 122 on the one hand and the hollow space 108 on the other hand, it provides an acoustic coupling between these two volume regions. Although not shown in the figure, the membranes of the electroacoustic transducer 112 may optionally comprise very small air channels for pressure equilibration between air within the hollow space 108 on the one hand and the exterior atmosphere surrounding casing 120 and being acoustically coupled to the electroacoustic transducer 112 via the through holes 110, 114, 122.

Not only the electroacoustic transducer 112, but also the electronic chip 116 constituting the logic chip for cooperation with the electroacoustic transducer 112, is mounted within the hollow space 108 delimited by the first substrate 102 and the lid 104. Moreover, (in the shown embodiment three) additional electronic members 118, each embodied as a further semiconductor chip, are also mounted on the first substrate 102 within the hollow space 108, i.e. covered by the same lid 104 as the electroacoustic transducer 112 and the electronic chip 116. The electronic members 118 provide further electronic functions of the electronic device 100, such as a GPS function, a frequency filtering function, a memory function, a controller function or the like.

The electronic device 100 furthermore comprises the exterior casing 120 enclosing (with the exception of the casing through hole 122 hermetically) all previously described components, in particular the lid 104 and the first substrate 102 as well as the second substrate 130. The exterior surface of the casing 120 provides, along the entire circumference of the electronic device 100, the outermost limit of the electronic device 100. The only acoustic interface between the interior of the casing 120 and an exterior atmosphere 124 is the external through hole 122.

The electronic device 100 furthermore has an acoustic sealing 126 which comprises a sealing element arranged to bridge a gap between the second substrate 130 and the first substrate 102 for preventing leakage of acoustic waves, entering the electronic device 100 via the external through hole 122 and the main board through hole 114, into an intermediate space between the casing 120 and the lid 104. The acoustic sealing 126 as well suppresses leakage of acoustic waves, entering the electronic device 100 via the external through hole 122 into an intermediate space between the exterior casing 120 and the second substrate 130. For this purpose, the acoustic sealing 126 also comprises a sealing element arranged to bridge the second substrate 130 with regard to the casing 120. In the shown embodiment, the acoustic sealing 126 is configured as two rubber rings, two solder rings or two adhesive rings, one of which being arranged between the second substrate 130 and the first substrate 102, and the other one being arranged between the second substrate 130 and the exterior casing 120.

In the shown configuration, the lid 104 is made of a metallic material for shielding electromagnetic radiation from an environment of the electronic device 100. Such stray radiation may deteriorate in particular the function of the electroacoustic transducer 112, the electronic chip 116 and the electronic members 118. In the shown embodiment, the lid 104 fulfils therefore particularly two functions: (1) shielding electromagnetic stray radiation from components arranged within the substrate-lid arrangement; (2) providing a pronounced, large back volume for the electroacoustic transducer 112 for promoting its performance in terms of signal-to-noise ratio.

Thus, FIG. 1 shows an embodiment in which the integration of a silicon microphone as electromechanical transducer 112 as well as of the connected ASIC in the form of electronic chip 116 in an existing module is performed. Thus, a high back volume can be obtained without the need to implement extra components.

Hence, FIG. 1 illustrates a cross-section of the electronic device 100 in which the cup-shaped lid 104 within the exterior housing 120 forms, together with the first substrate 102 on which the electroacoustic transducer 112 with its electronic chip 116 and the further electronic members 118 are mounted, the back volume for the electroacoustic transducer 112.

Figure 2:
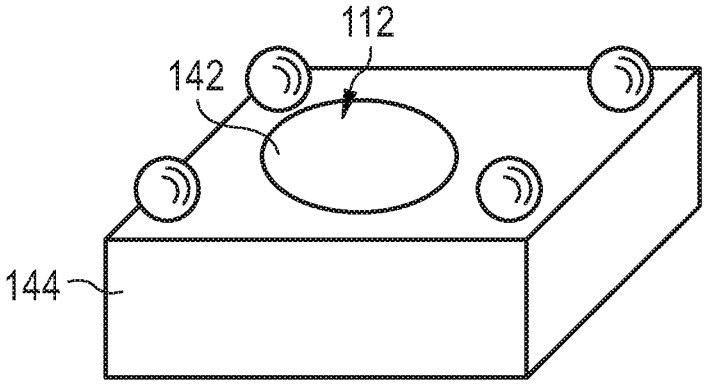
FIG. 2 shows a three-dimensional view of an electroacoustic transducer having an assigned electronic chip (not shown) for use with an electronic device according to an exemplary embodiment.

FIG. 2 shows a three-dimensional view of an electromechanical transducer 112 which can be implemented in an electronic device 100 according to an exemplary embodiment as well. The electromechanical transducer 112 is here configured as a highly integrated structure having a tubular support structure 144 which can be an annulus of crystalline silicon. On top of the through hole of the support structure 200, a pair of membranes 142 with a thickness in a range between 100 nm and 1000 nm is formed. The electronic chip 116 is not shown in FIG. 2 and can be mounted at an appropriate position within the electronic device 100.

Figure 3:
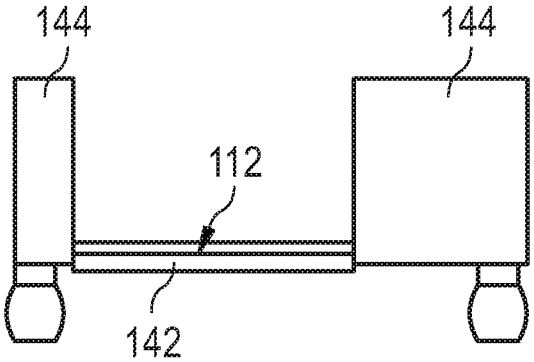
FIG. 3 shows a side view of the electroacoustic transducer-electronic chip assembly of FIG. 2.

FIG. 3 shows a side view of the arrangement of FIG. 2 from which the high compactness of the arrangement can be derived.

Figure 4:
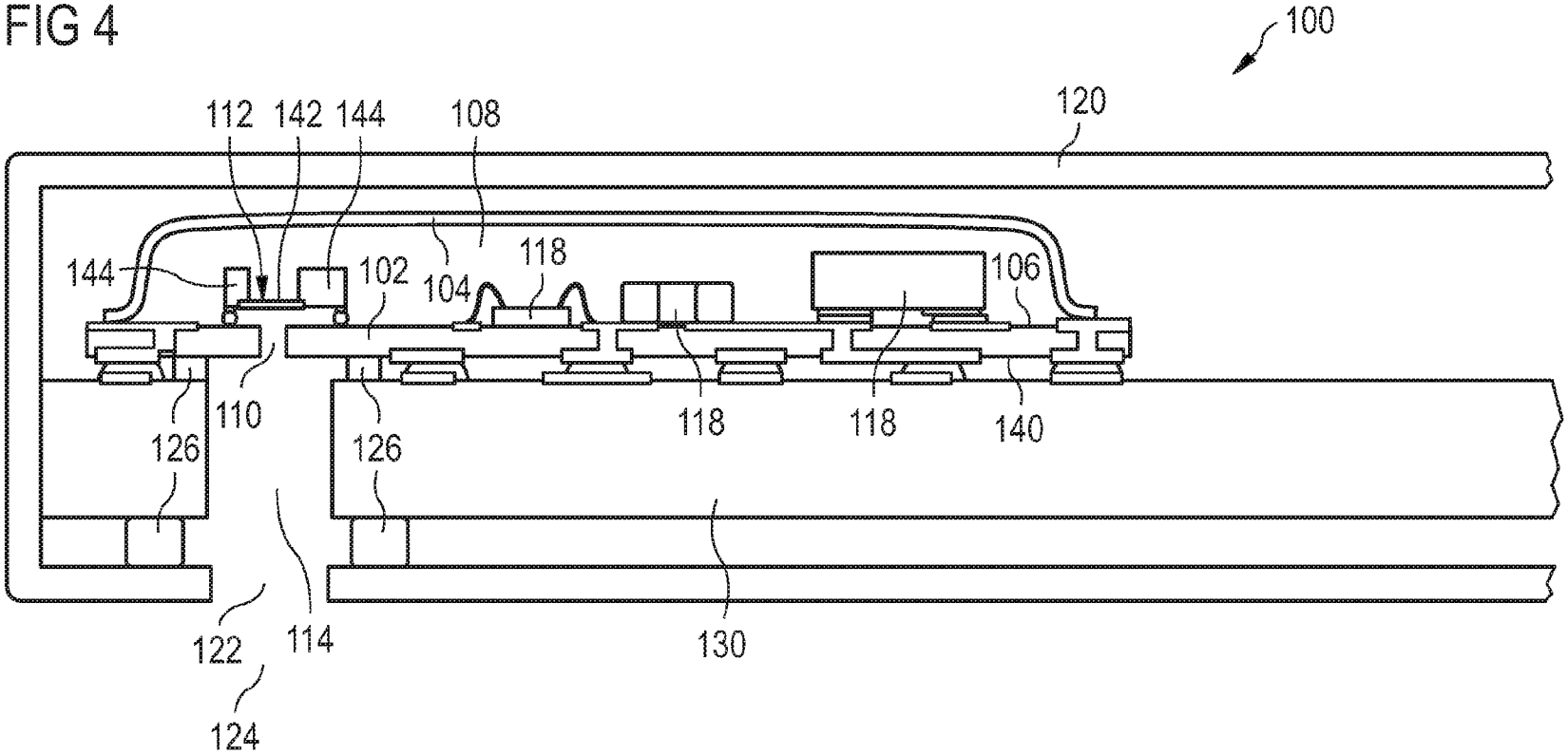
FIG. 4 shows an electronic device according to another exemplary embodiment being similar to FIG. 1 but having implemented the electroacoustic transducer-electronic chip assembly of FIG. 2 and FIG. 3.

FIG. 4 now shows an electronic device 100 according to an exemplary embodiment in which the electromechanical transducer 112 of FIG. 2 and FIG. 3 is implemented. This is also the main difference in comparison with the embodiment of FIG. 1. Although not shown in FIG. 4, the electronic chip 116 can be mounted elsewhere within the lid 104-substrate 102, 130 arrangement or juxtaposed to one of the through holes 110, 114, 122. The FIG. 4 embodiment enables the use of smallest footprint silicon microphones with highest performance.

Figure 5:
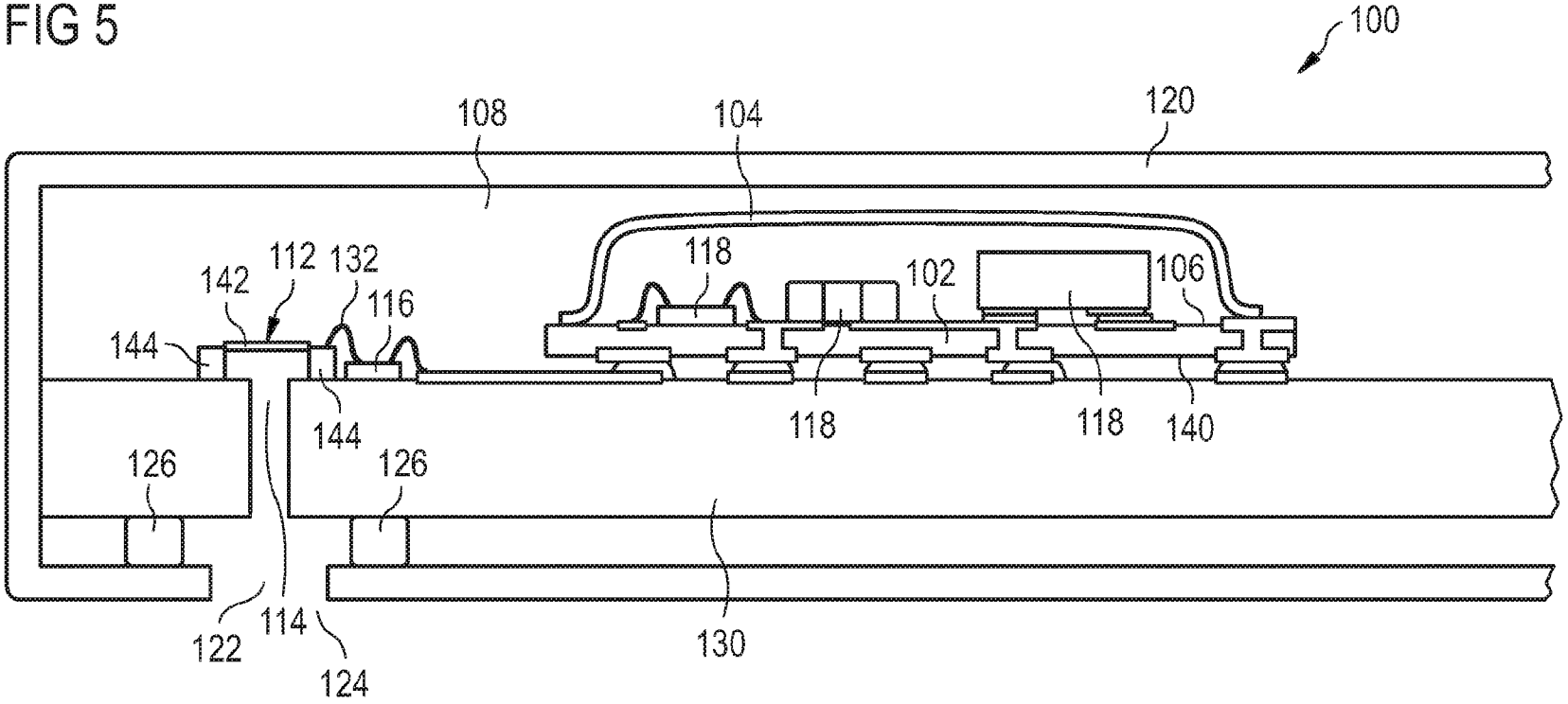
FIG. 5 illustrates an electronic device according to another exemplary embodiment in which a back volume of an electroacoustic transducer is delimited by a main board in combination with a part of an exterior casing of the electronic device, the part constituting a cover.

FIG. 5 illustrates an electronic device 100 according to still another exemplary embodiment which differs from the embodiment of FIG. 1 particularly in that the lid 104 now covers only the electronic members 118 mounted on the first substrate 102, whereas the electroacoustic transducer 102 as well as the electronic chip 116 are now mounted directly on the second substrate 130 and outside of the lid 106. The back volume being equivalent to the hollow space 108 is now constituted between the second substrate 130 on the one hand and a cover (see particularly an upper cup-shaped portion of the exterior casing 120 of the electronic device 100) on the other hand. In other words, a cover-substrate arrangement is formed, according to FIG. 5, by an upper portion of the exterior casing 120 and by the second substrate 130.

Thus, in the embodiment of FIG. 5, the overall device housing in form of the exterior casing 120 can be used for delimiting the back volume. Thus, an ultra-high back volume can be obtained.

An acoustic sealing 126 may be formed between the external casing 120 and the second substrate 130 in form of the main board. The electromagnetic shielding function for protecting the electronic members 118 from stray radiation may be provided by the lid 104 enclosing the electronic members 118, and by the external casing 120 particularly with regard to electroacoustic transducer 112 and electronic chip 116. For this purpose, it is for instance possible to coat the surface of the casing 120 (for instance made of a plastic material) with a metallic material, or to form the entire external casing 120 of a metal. Moreover, a shielding of the electroacoustic transducer 112 and the electronic chip 116 from the electronic members 118, and vice versa, may be provided by the lid 104 as well.

Concluding, FIG. 5 illustrates the electronic device 100 in which the back volume of the electroacoustic transducer 112 is delimited by the main board in combination with a part of the exterior casing 120 of the electronic device 100, the latter part constituting a cover contributing to the delimiting of a back volume for a microphone.

While FIG. 5 shows a chip on board assembly of the MEMS chip and the ASIC, it is of course also possible to configure the embodiment of FIG. 5 with a MEMS microphone system of the type as shown in FIG. 2 to FIG. 4.

Figure 6:
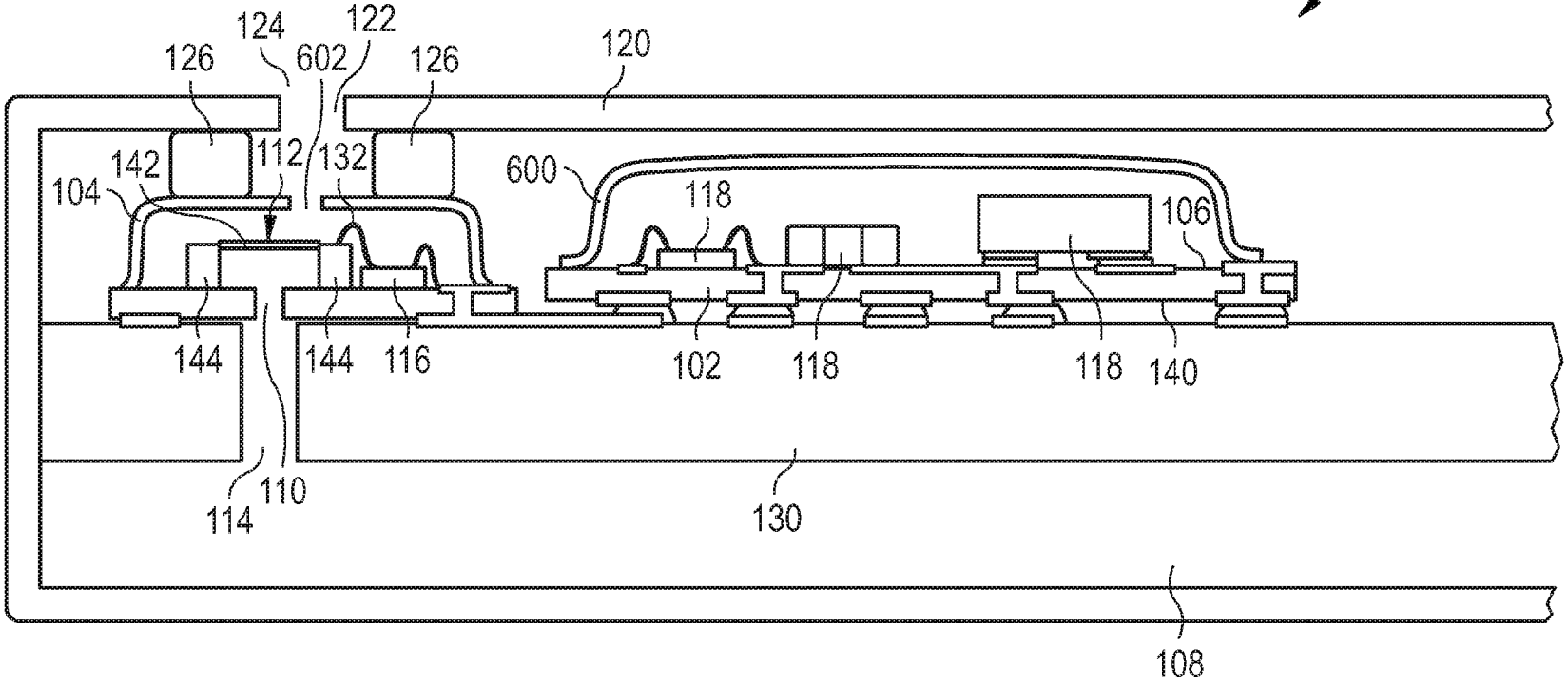
FIG. 6 illustrates an electronic device according to yet another exemplary embodiment in which a back volume of an electroacoustic transducer is delimited by a main board in combination with a part of an exterior casing of the electronic device, the part constituting a cover, wherein the electroacoustic transducer together with an assigned electronic chip are additionally covered by a further cover having a further through hole.

FIG. 6 illustrates an electronic device 100 according to yet another exemplary embodiment. In this embodiment, in comparison to FIG. 5, a separate second lid 600 is provided, wherein the previously mentioned first lid 104 covers the electroacoustic transducer 112 and the electronic chip 116, whereas the second lid 600 hermetically covers the electronic members 118. In such an embodiment, the electromagnetic shielding for the components may be realized by the lids 104, 600, so that the external casing 120 (which serves for delimiting the back volume in this embodiment) may for instance be made of plastic material so that the design freedom with regard to the casing 120 is increased. FIG. 6 is another example for the use of the overall device housing or casing 120 as contributing to the hollow space 108 or back volume, and shows an example of a top port silicon microphone as the electroacoustic transducer 112. The benefit of this embodiment is that a high back volume can be obtained with a top port configuration.

FIG. 6 thus illustrates the electronic device 100 in which the back volume of the electroacoustic transducer 112 is delimited by the second substrate 130 or main board in combination with a bottom part of the exterior casing 120 of the electronic device 100, wherein this cup-shaped part constitutes a lid-like member.

In the embodiment of FIG. 6, the main board through hole 114 provides for an acoustic communication between the electroacoustic transducer 112 and the hollow space 108. The external through hole 122 in combination with a lid through hole 602 provide for an access of sound waves from an external atmosphere 124 towards the electroacoustic transducer 112.

Figure 7:
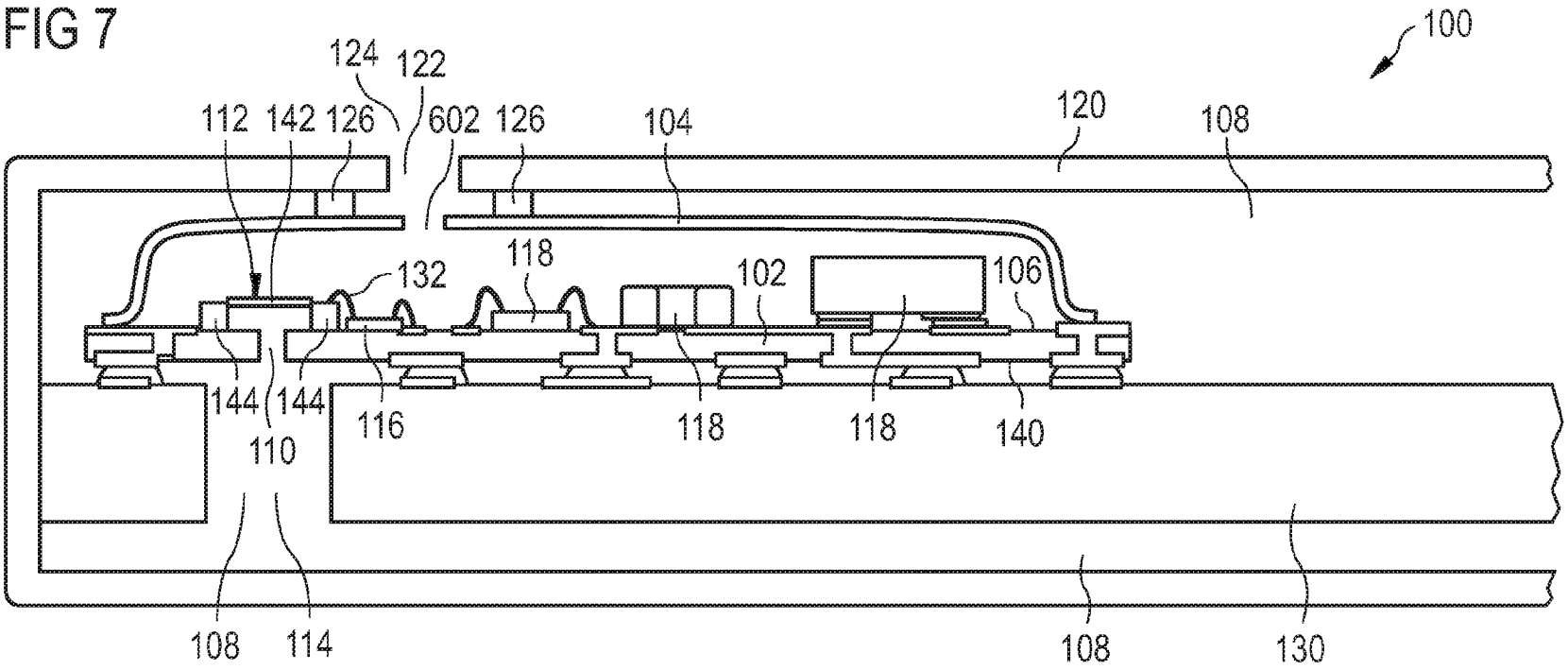
FIG. 7 shows a cross-section of an electronic device according to yet another exemplary embodiment in which, compared to FIG. 6, separate lids for the electroacoustic transducer-electronic chip assembly and for further electronic members are combined to a common lid.

FIG. 7 shows an electronic device 100 according to yet another exemplary embodiment. The embodiment of FIG. 7 differs from the embodiment of FIG. 6 in that one common lid 104 (rather than two lids 104, 600, as in FIG. 6) is now provided for both the electroacoustic transducer 112 with connected electronic chip 116, and the electronic members 118. Thus, a high back volume may be obtained without the necessity of providing additional components, since the integration in one shielded module is possible. No extra shielding is needed. The back volume is extremely high in this embodiment.

FIG. 7 therefore shows a cross-section of the electronic device 100 in which, compared to FIG. 6, separate lids 104, 600 for the electroacoustic transducer 112-electronic chip 116 assembly and for further electronic members 118 are combined to one common lid 104.

It should be noted that the term "comprising" does not exclude other elements or features and the "a" or "an" does not exclude a plurality. Also elements described in association with different embodiments may be combined. It should also be noted that reference signs shall not be construed as limiting the scope of the claims. Moreover, the scope of the present application is not intended to be limited to the particular embodiments of the process, machine, manufacture, composition of matter, means, methods and steps described in the specification. Accordingly, the appended claims are intended to include within their scope such processes, machines, manufacture, compositions of matter, means, methods, or steps.

What is claimed is:

1. An electronic device, comprising:

a substrate;

a cover delimiting at least a part of a main surface of the substrate from an exterior to thereby form a cover-substrate enclosing a hollow space and having a through hole, the cover being at least partially delimiting the hollow space and being at least part of a hollow casing fully surrounding the substrate;

an electroacoustic transducer configured for converting between an acoustic signal and an electric signal and being mounted on the substrate acoustically coupled to the hollow space in such a way that the hollow space constitutes a back volume of the electroacoustic transducer, wherein the electroacoustic transducer provides an acoustical coupling between the hollow space and an exterior of the cover-substrate arrangement via the through hole;

an electronic chip mounted within the cover-substrate arrangement and electrically coupled with the electroacoustic transducer for communicating electric signals between the electronic chip and the electroacoustic transducer; and at least one electronic member mounted on the substrate within the cover-substrate arrangement and configured for providing an electronic function;

a lid different from the cover, the lid covering and electromagnetically shielding the electroacoustic transducer and the electronic chip.

2. The device according to claim 1, wherein the substrate is a printed circuit board.

3. The device according to claim 2, wherein the printed circuit board is a main board of the device.

4. The device according to claim 1, wherein the casing is configured, in particular is made at least partially of an electrically conductive material, for electromagnetically shielding at least one of the group consisting of the electronic chip and the at least one electronic member with regard to an environment.

5. The device according to claim 1, wherein the electroacoustic transducer comprises at least one of the group consisting of a microphone configured for converting an acoustic signal into an electric signal, and a loudspeaker configured for converting an electric signal into an acoustic signal.

6. The device according to claim 1, wherein the electroacoustic transducer is configured as a microelectromechanical system.

7. The device according to claim 1, wherein the electronic chip is an application specific integrated circuit.

8. The device according to claim 1, wherein the at least one electronic member is electrically coupled to the electronic chip.

9. The device according to claim 1, wherein the lid is configured, in particular is made at least partially of an electrically conductive material, for electromagnetically shielding the at least one electronic member with regard to an environment.

10. The device according to claim 1, wherein the through hole is formed in at least one of the group consisting of the cover, and the substrate.

11. The device according to claim 1, comprising a further cover covering at least one of the at least one further electronic member, but not the electroacoustic transducer and the electronic chip.

12. The device according to claim 1, wherein an outer surface of the cover, the cover being configured as a casing, at least partially forms an outer surface of the device.

13. The device according to claim 1, wherein the electronic chip is mounted on the substrate.

14. The device according to claim 1, wherein a first exterior surface of a pair of membranes of the electroacoustic transducer faces the through hole and an opposing second exterior surface of the pair of membranes opposes the through hole, wherein the second exterior surface is directly acoustically coupled to an inner surface of the cover delimiting the back volume and at least partially surrounding, together with the substrate, the electronic chip and the at least one electronic member.

15. A multimedia device, comprising:

a circuit board having an internal through hole;

an exterior housing exposed to an exterior of the multimedia device, enclosing the circuit board, delimiting a hollow space together with the circuit board and having an external through hole;

a pair of microphone membranes configured for converting an acoustic signal into an electric signal and being mounted on the circuit board acoustically coupled to the hollow space in such a way that the hollow space constitutes a back volume of the pair of microphone membranes, wherein the pair of microphone membranes provides an acoustical coupling between the hollow space and an exterior of the multimedia device via the internal through hole and the external through hole;

an electronic chip mounted within the exterior housing and electrically coupled to the pair of microphone membranes for processing electric signals generated by the pair of microphone membranes in response to receiving acoustic signals by the pair of microphone membranes via the external through hole;

a lid different from the exterior housing, the lid covering and electromagnetically shielding the electroacoustic transducer and the electronic chip.

16. The device according to claim 15, comprising at least one electronic member mounted on the circuit board within the hollow space and configured for providing an electronic function.

17. A method of manufacturing an electronic device, the method comprising:

delimiting at least a part of a main surface of a substrate from an exterior with a cover to thereby form a cover-substrate arrangement enclosing a hollow space and having a through hole, wherein the cover is at least partially delimiting the hollow space and is at least part of a hollow casing fully surrounding the substrate;

mounting an electroacoustic transducer configured for converting between an acoustic signal and an electric signal on the substrate acoustically coupled to the hollow space in such a way that the hollow space constitutes a back volume of the electroacoustic transducer, wherein the electroacoustic transducer provides an acoustical coupling between the hollow space and an exterior of the cover-substrate arrangement via the through hole;

mounting an electronic chip within the cover-substrate arrangement and electrically coupling the electronic chip with the electroacoustic transducer for communicating electric signals between the electronic chip and the electroacoustic transducer; and mounting at least one electronic member, configured for providing an electronic function, on the substrate within the cover-substrate arrangement;

mounting a lid covering and electromagnetically shielding the electroacoustic transducer and the electronic chip, the lid being different from the cover.

* * * * *